US009272173B2

(12) United States Patent
Kempka

(10) Patent No.: US 9,272,173 B2
(45) Date of Patent: Mar. 1, 2016

(54) RECIRCULATING RATCHETING PLYOMETRIC ASSEMBLY

(71) Applicant: Russell Kempka, Grafton, WI (US)

(72) Inventor: Russell Kempka, Grafton, WI (US)

(73) Assignee: Russell A. Kempka, Jr., Grafton, WI (US)

( * ) Notice: Subject to any disclaimer, the term of this patent is extended or adjusted under 35 U.S.C. 154(b) by 121 days.

(21) Appl. No.: 14/057,783

(22) Filed: Oct. 18, 2013

(65) Prior Publication Data

US 2015/0111701 A1 Apr. 23, 2015

(51) Int. Cl.
*A63B 5/16* (2006.01)
*A63B 71/06* (2006.01)

(52) U.S. Cl.
CPC ..... *A63B 5/16* (2013.01); *A63B 2071/0694* (2013.01); *A63B 2210/50* (2013.01); *A63B 2225/093* (2013.01)

(58) Field of Classification Search
CPC ..... A63B 5/00; A63B 5/02; A63B 5/12; A63B 5/05; A63B 21/00047; A63B 21/00087; A63B 21/00094; A63B 21/068; A63B 21/078; A63B 21/1457; A63B 21/1465; A63B 22/0046; A63B 2022/0092; A63B 23/0458; A63B 69/0028; A63B 69/0035; A63B 2208/0204; A63B 2208/0209; A63B 2225/093; A47C 16/025; A47D 1/004; A47B 45/00; A61G 7/012; A61G 13/06
USPC ..... 297/423.45, 338, 344.18; 312/205; 248/127, 146, 149, 150, 151, 152
See application file for complete search history.

(56) References Cited

U.S. PATENT DOCUMENTS

| | | | | | |
|---|---|---|---|---|---|
| 4,203,525 | A * | 5/1980 | Okubo | A63B 5/12 | 206/501 |
| D332,647 | S * | 1/1993 | Johnson | D21/671 | |
| 5,599,258 | A * | 2/1997 | Stone | A47C 12/02 | 297/440.1 |
| 5,683,331 | A * | 11/1997 | Dalebout | A63B 23/0458 | 248/421 |
| 6,634,712 | B2 * | 10/2003 | Gamble | 297/338 | |
| 2005/0187074 | A1 * | 8/2005 | Barr | A47C 16/025 | 482/79 |
| 2009/0124464 | A1 * | 5/2009 | Kastelic | A63B 17/04 | 482/52 |
| 2012/0202652 | A1 * | 8/2012 | Ross | A63B 23/0458 | 482/52 |
| 2012/0245635 | A1 * | 9/2012 | Baksinski | 606/237 | |

* cited by examiner

*Primary Examiner* — Loan H Thanh
*Assistant Examiner* — Jennifer M Deichl

(57) ABSTRACT

The present invention is a telescoping plyometric exercise device which can be rapidly adjusted for height using a single lifting motion. The apparatus is incrementally height-adjusted and secured in a position capable of withstanding force. The apparatus requires a single lifting motion to securely and incrementally adjust the device, and to balance impact and force through the use of novel, contoured inner components and structural assemblies. These inner components and structural assemblies are engineered to provide the capability for rapid height adjustment of the apparatus.

16 Claims, 21 Drawing Sheets

RECIRCULATING RATCHETING PLYOMETRIC ASSEMBLY

FIELD OF INVENTION

This invention relates to the field of exercise equipment, and more specifically to a recirculating ratcheting assembly utilized in plyometric equipment.

BACKGROUND

Plyometrics, also known as "jump training," are primarily used by athletes, especially martial artists, high jumpers, to improve performance and are used in the fitness field to a much lesser degree. This type of training program does not require mechanical equipment or set up time.

Plyometric exercises are high-intensity, forceful moves designed to increase muscle speed and power by having a user to jump on or off a platform. Plyometrics routines require the plyometric platform height to be height-adjusted to accommodate the user and the progression of the training.

Originally used in training drills for athletes, plyometrics are rapidly being integrated into gym workouts and group exercise classes. There is a growing market for plyometrics equipment to supply gyms, health clubs and other work-out facilities with durable equipment that will withstand the high impact of many users.

As the trend in plyometrics moves from specialized athletic training to the general population, the usage of the equipment will be much heavier than the usage of equipment formerly experienced in specialized training environments. Many users will experience plyometrics through group classes and environments. The physical wear on the equipment is of concern.

There are advantages to plyometric equipment for home use and in settings such as schools where mechanized equipment is not practical. One advantage safety. Since there are no fast-moving mechanical such as belts or spokes, the equipment does not pose a hazard to children or pets. The equipment does not produce noise, and the moving parts do not require servicing.

A further concern as plyometrics moves into the commercial market is that there must be room to store the equipment. Although users require various levels of customized training and equipment, and facilities have limited storage capability and work-out space to accommodate work-out equipment which must be stored on the periphery of the work-out area for specific classes. Other users require compact devices which can be stored at home in living areas.

As opposed to specialized training environments, the devices must be readily adaptable for users of different heights and body proportions.

It is a further problem known in the art that detachable components which are user-modifiable to customize a device easily lost.

It is a further problem known in the art that users must be able to easily adjust equipment in a work out facility without special tools, equipment or training.

It is desirable to have plyometric work-out device that structurally meets the needs of commercial facilities and individual users in a growing market.

SUMMARY OF THE INVENTION

The present invention is a telescoping plyometric device utilizing a novel ratcheting system capable of bearing weight. The invention includes two telescoping structures designated as "outer" and "inner" telescoping structures. The system further includes at rod having a cylindrical face. A first side and a second side of the inner structure have at least one slot with a diameter equal to or larger than the cylindrical face of the at least one rod. At least two sides of the outer structure have a series of contours comprising a plurality of semi-circular contours interspersed with a plurality downward sloping contours. This series of contours begins at an angled upper surface and ends at an angled lower surface. The semi-circular contours comprise a radius equal to or larger than said cylindrical face of at least one rod, while the downward sloping contours comprise faces angled between zero and ninety degrees to push the at least one rod in a laterally outward direction.

The rod component transfers weight to the lower assembly and the contours themselves are capable of bearing weight.

DETAILED DESCRIPTION OF INVENTION

Figure 1:
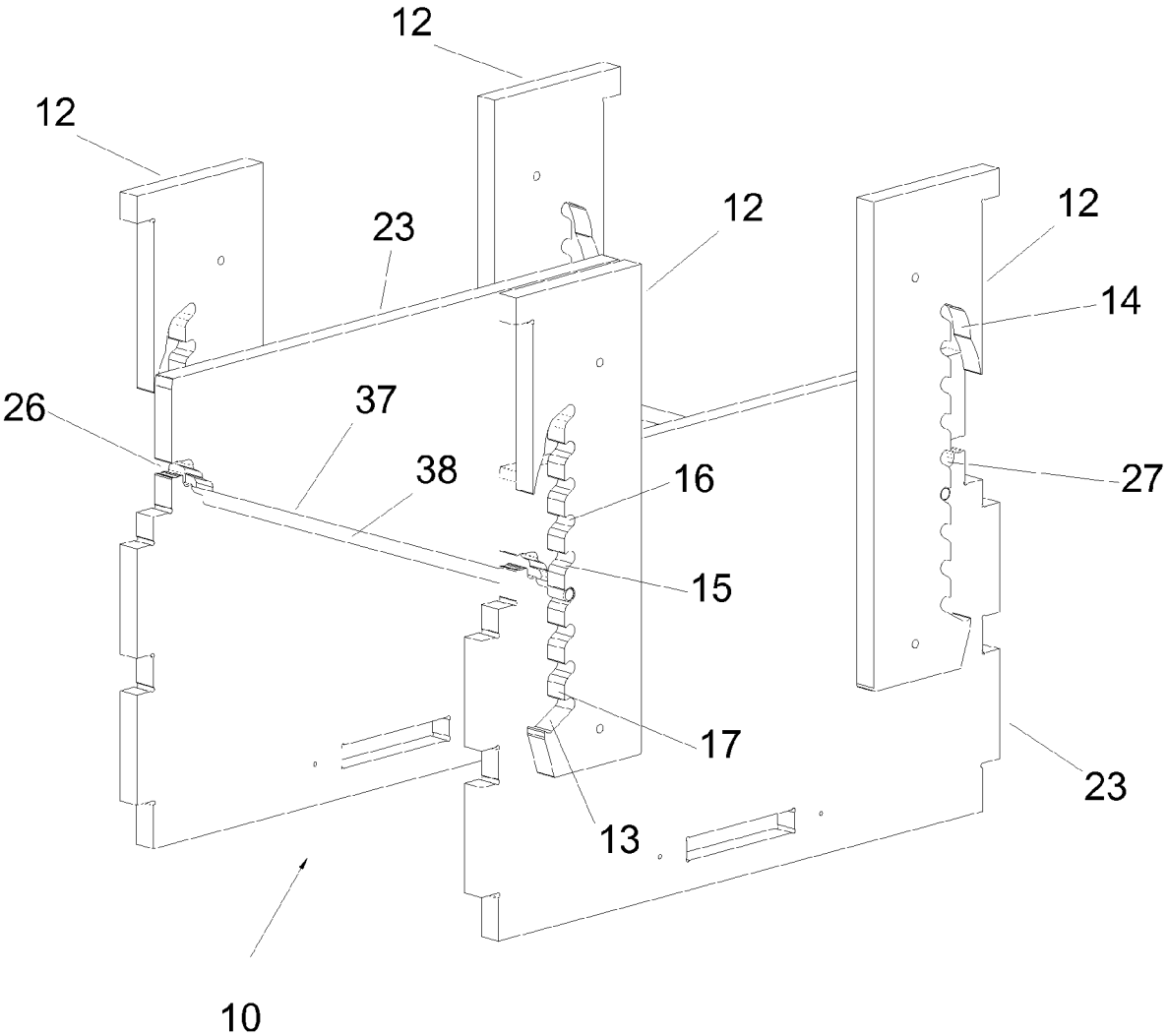
FIG. 1 illustrates an isometric view of the recirculating ratchet assembly.

For the purpose of promoting an understanding of the present invention, references are made in the text to exemplary embodiments of a ratcheting device, only some of which are described herein. It should be understood that no limitations on the scope of the invention are intended by describing these exemplary embodiments. One of ordinary skill in the art will readily appreciate that alternate but functionally equivalent parts or components may be used. The inclusion of additional elements may be deemed readily apparent and obvious to one of ordinary skill in the art. Specific elements disclosed herein are not to be interpreted as limiting, but rather as a basis for the claims and as a representative basis for teaching one of ordinary skill in the art to employ the present invention.

It should be understood that the drawings are not necessarily to scale; instead emphasis has been placed upon illustrating the principles of the invention. In addition, in the embodiments depicted herein, like reference numerals in the various drawings refer to identical or near identical structural elements.

Moreover, the terms "substantially" or "approximately" as used herein may be applied to modify any quantitative representation that could permissibly vary without resulting in a change in the basic function to which it is related.

Referring to FIG. 1, a recirculating ratcheting assembly is designated by the reference number 10. The device is referred to as "recirculating" because it mechanically resets from the highest ratchet position when extended past the maximum height.

Figure 9:
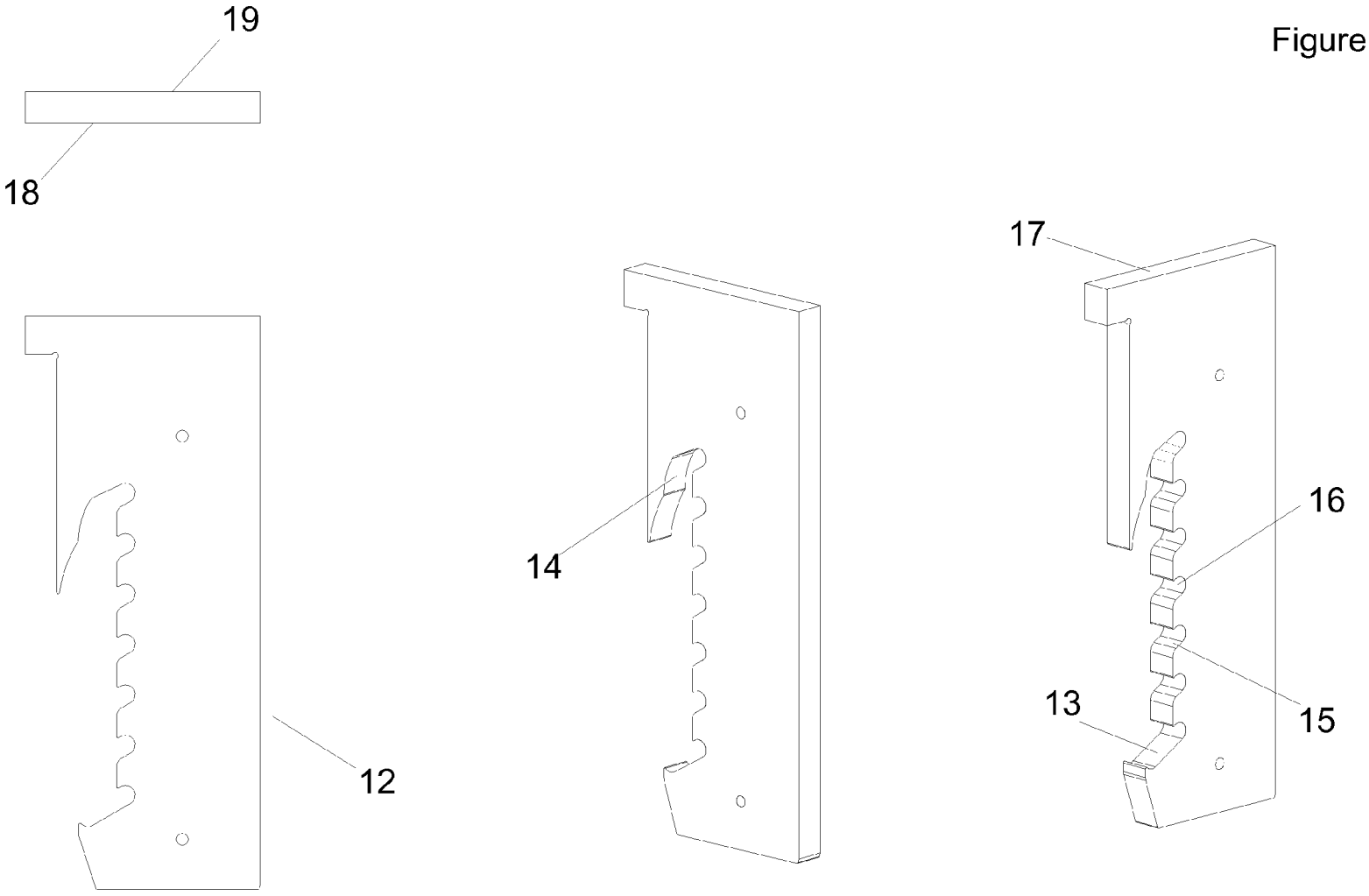
FIG. 9 illustrates multiple views of a rack of the instant recirculating ratchet assembly.

Ratcheting assembly 10 includes at least one rack 12 which is moved vertically during its operation, at least one indexing rod 37 and at least one side plate 23. As shown in FIG. 9, the rack 12 as a rectangular shaped member having an upward face 18 and a second downward face 19. The two faces are connected by a contoured sidewall 17.

Figure 10:
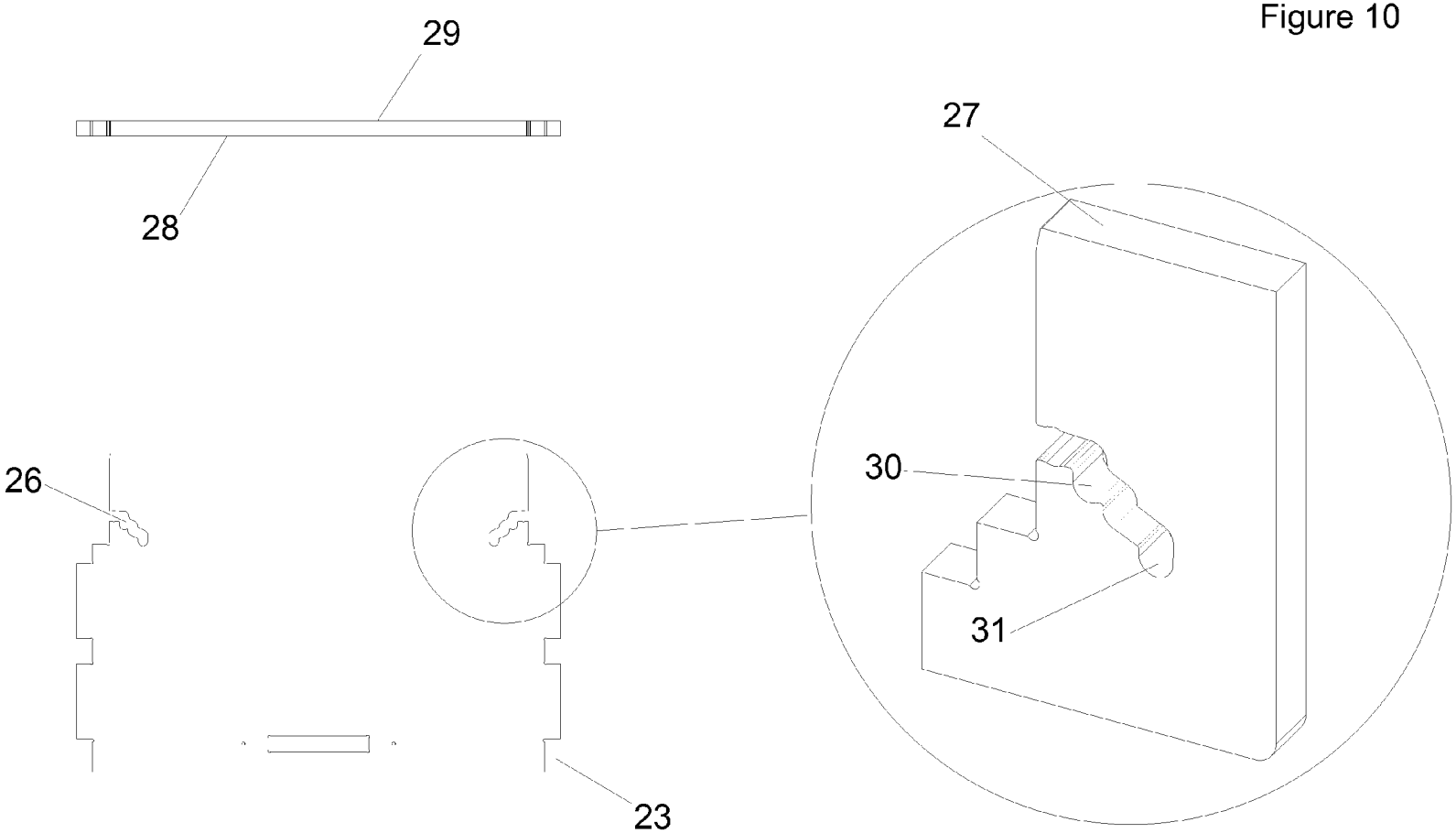
FIG. 10 illustrates multiple views of a side plate of the instant recirculating ratchet assembly.
Figure 11:
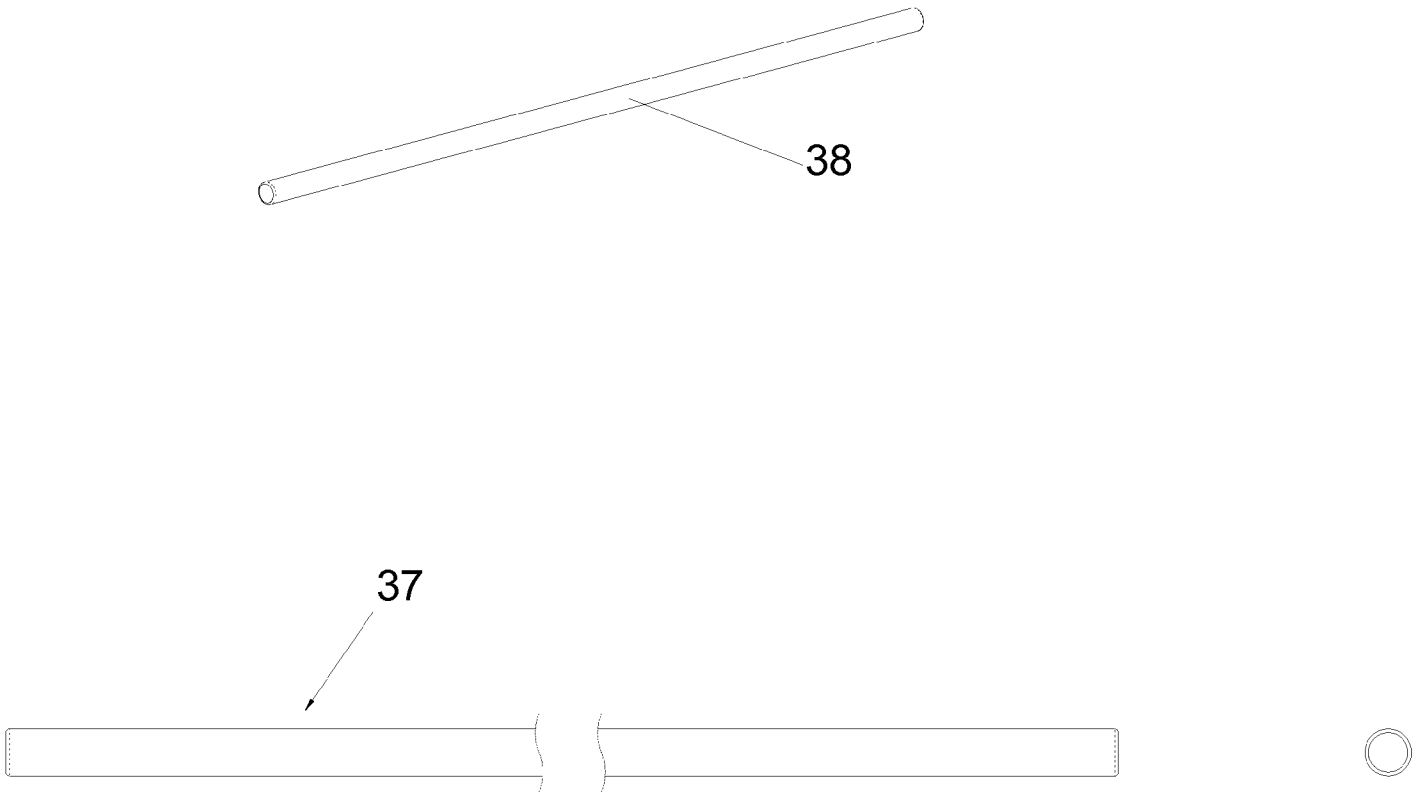
FIG. 11 illustrates multiple views of a rod of the instant recirculating ratchet assembly.

As shown in FIG. 10, the side plate 23 has an upward face 28 and a second, downward face 29. The two faces are connected by a contoured sidewall 27. Side plate 23 also includes a contoured slot 26 that supports cylindrical face 38 of rod 37. FIG. 11 shows rod 37 with cylindrical face 38.

Figure 2:
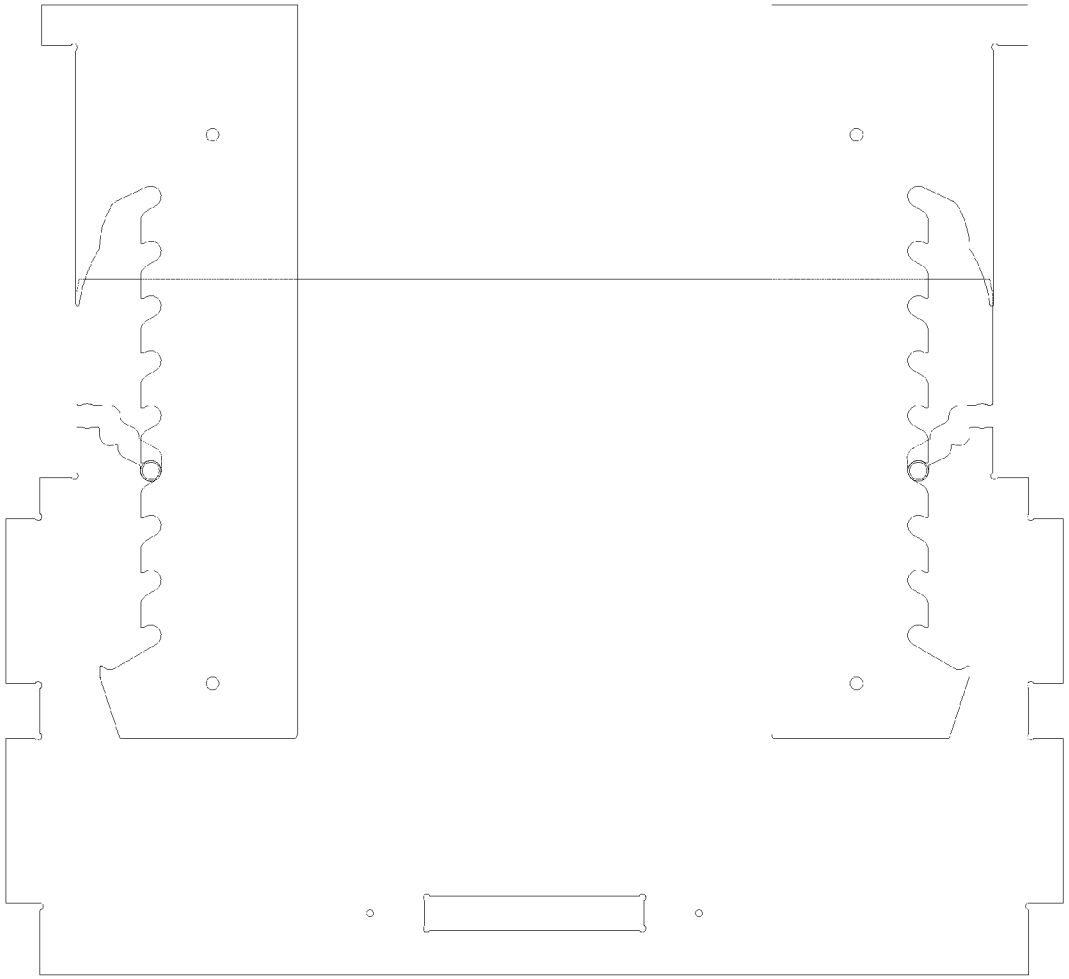
FIG. 2 illustrates a side view of the recirculating ratchet assembly at one stage of the movement cycle.

Referring to FIGS. 1 and 2, when rod 37 is positioned in slot 26, the cylindrical face 38 of rod 37 communicates the sidewall 27 of the side plate 23. Face 19 of rack 12 communicates with face 28 of side plate 23.

FIG. 2 shows the rack 12 and rod 37 in the seated position. Cylindrical face 38 of rod 37 rests on surface 31 of side plate 23. The semi-circular surface 16 of rack 12 rests on the cylindrical face 38 of rod 37. In this position, rack 12 is prevented from moving downward with respect to side plate 23.

Figure 3:
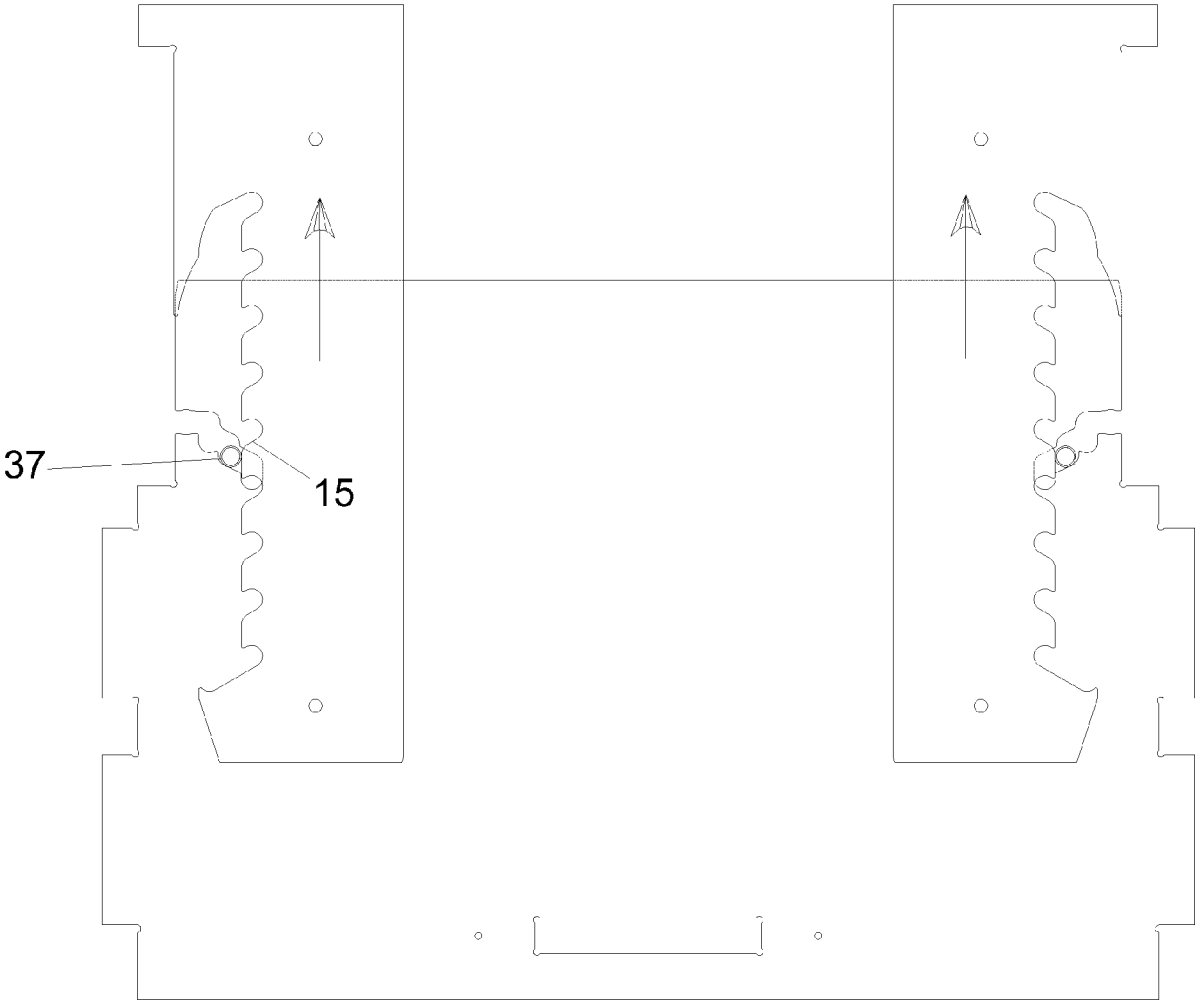
FIG. 3 illustrates a side view of the recirculating ratchet assembly at another stage of the movement cycle.

As shown in FIG. 3, when rack 12 is lifted vertically, angled face 15 contacts cylindrical face 38 of rod 37, thereby lifting rod 37 clear of the ratchet rack 12 and allowing each rack tooth to pass as rack 12 is lifted. As shown in FIG. 2, lowering rack 12 allows rod 37 to pass between the teeth of rack 12 and settle back onto surface 31 of side plate 23. With rod 37 in this position, it stops rack 12 from traveling down any further thus supporting rack 12 in this location.

Figure 4:
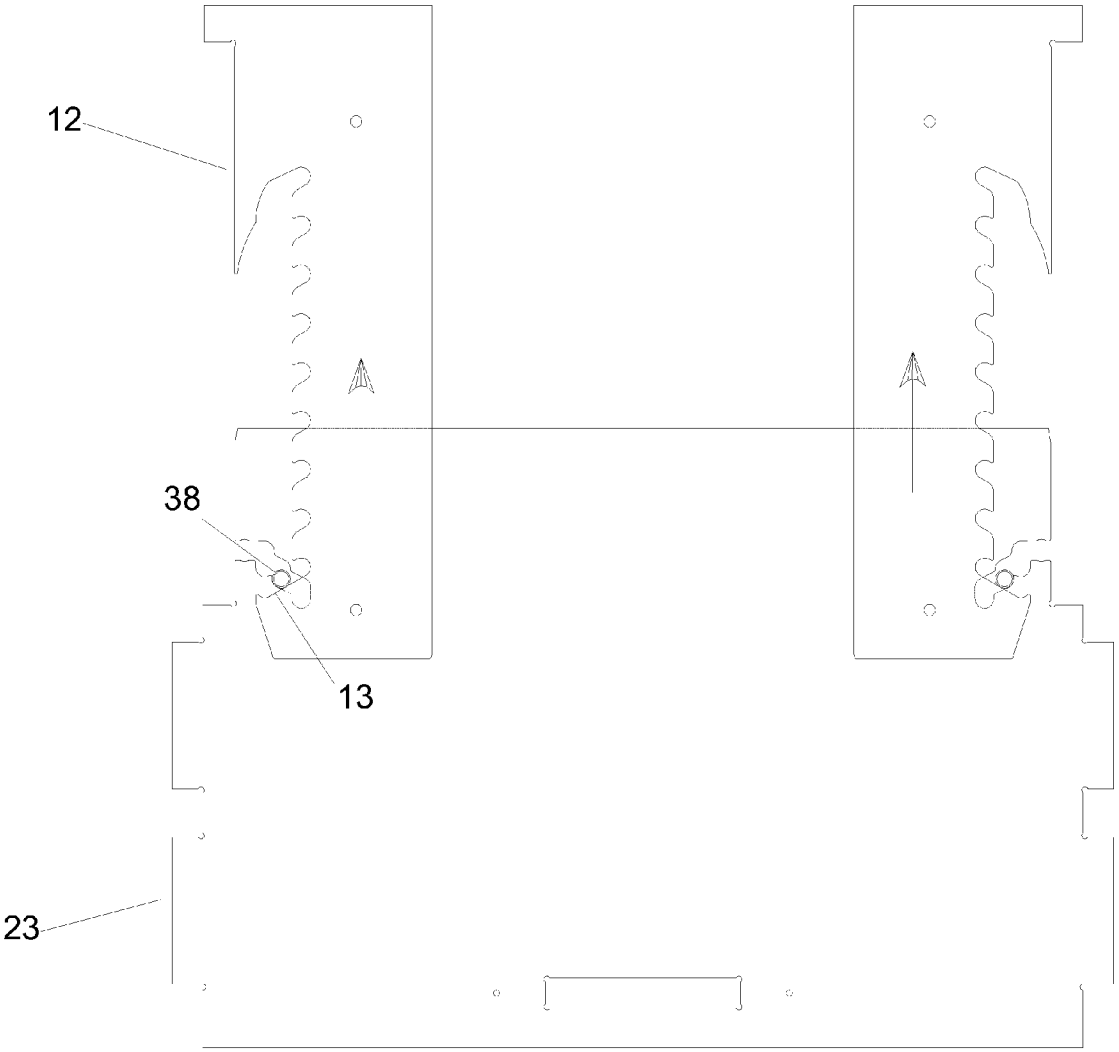
FIG. 4 illustrates a side view of the recirculating ratchet assembly at another stage of the movement cycle.
Figure 5:
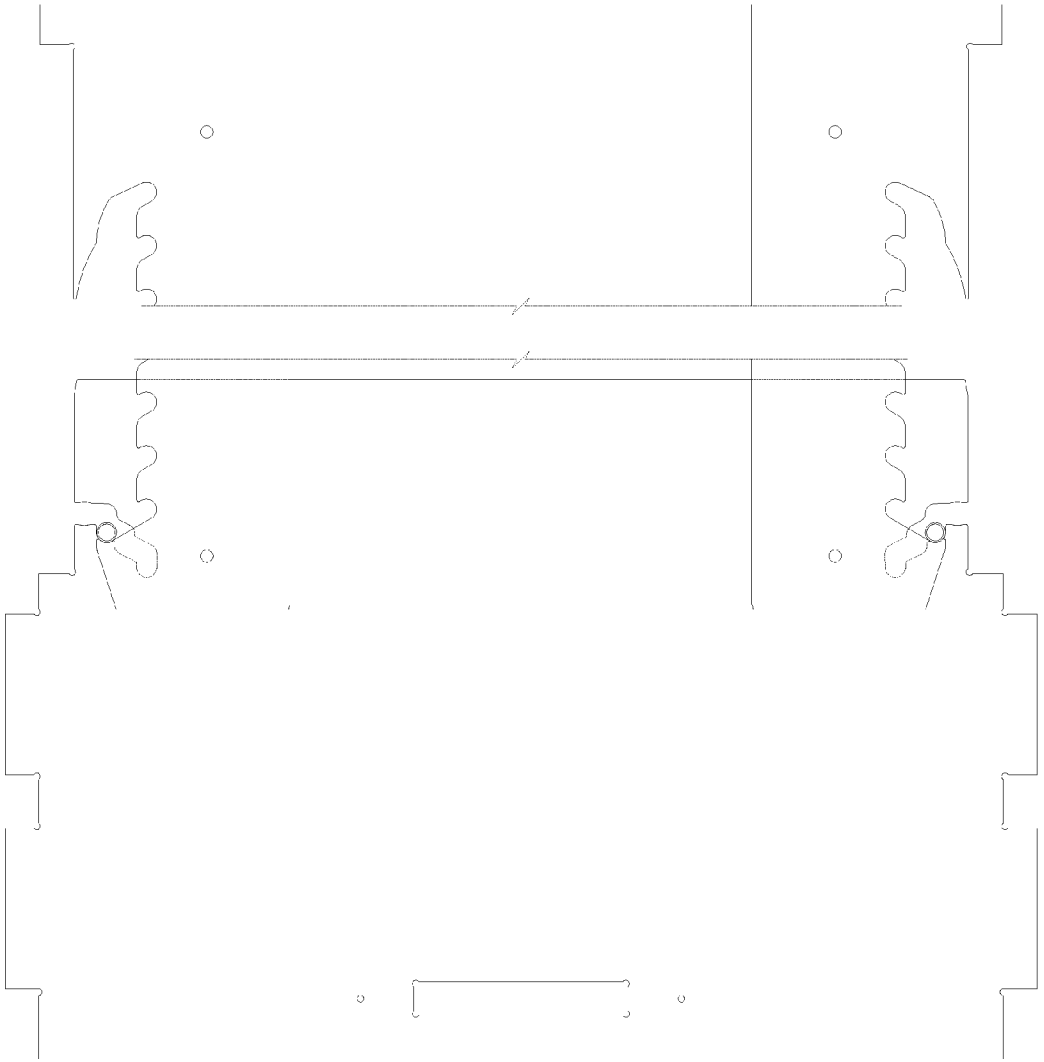
FIG. 5 illustrates a side view of the recirculating ratchet assembly at another stage of the movement cycle.
Figure 6:
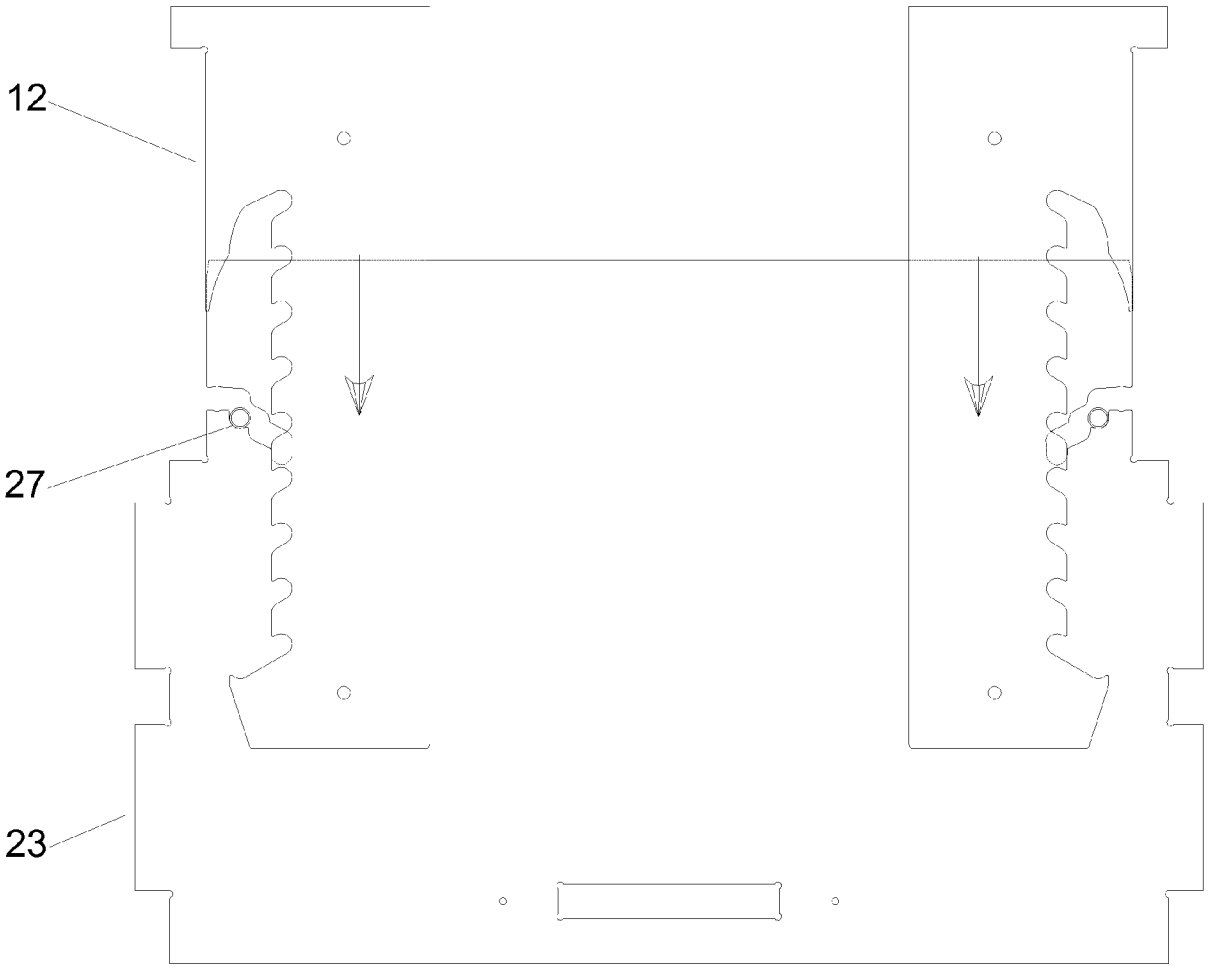
FIG. 6 illustrates a side view of the recirculating ratchet assembly at another stage of the movement cycle.
Figure 7:
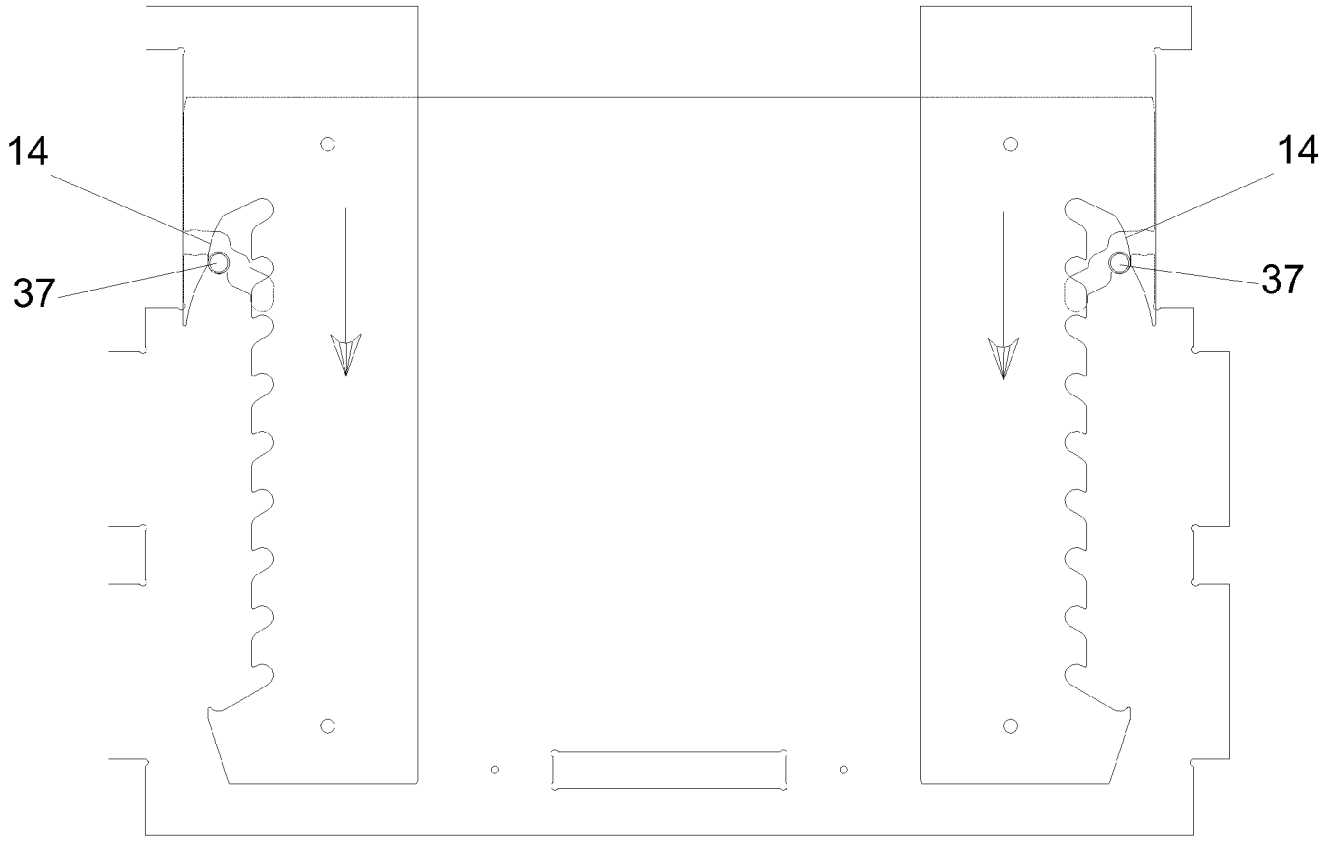
FIG. 7 illustrates a side view of the recirculating ratchet assembly at another stage of the movement cycle.
Figure 8:
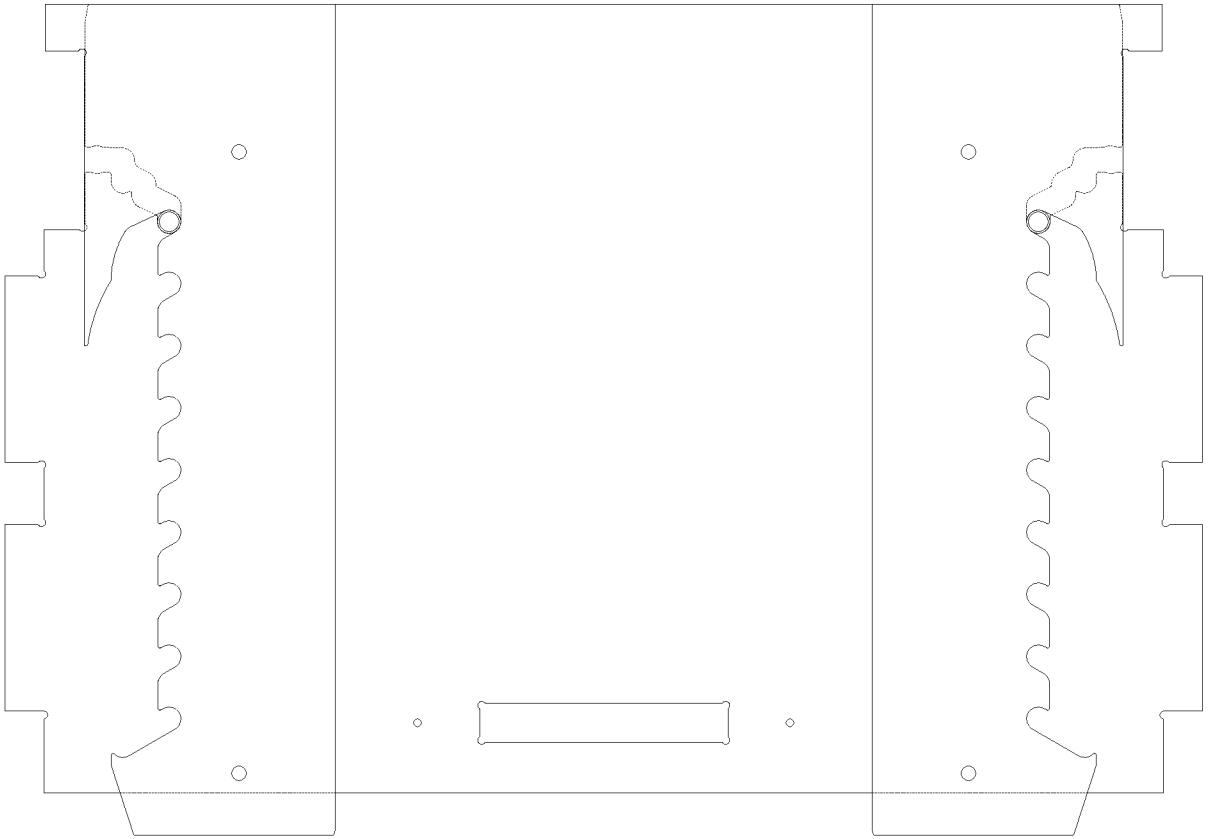
FIG. 8 illustrates a side view of the recirculating ratchet assembly at another stage of the movement cycle.

FIGS. 4, 5, 6, 7 and 8 detail resetting the ratchet assembly 10 so that it may be set to its lowest position as shown in FIG. 8. FIG. 4 shows rack 12 being lifted to a point where lower surface 13 of rack 12 contacts cylindrical face 38 of rod 37. Continuing to lift rack 12 allows lower surface 13 of rack 12 to contact cylindrical face 38 of rod 37, lifting it into the reset position as shown in FIG. 5. FIG. 6 shows rack 12 being lowered with rod 37 in the reset position sitting on surface 30 of side plate 23. As rack 12 continues downward, upper surface 14 of rack 12 will contact cylindrical face 38 of rod 37 removing it from surface 30 of side plate 23 and allowing rod 37 to drop down to surface 31 of side plate 23. This places rack 12 in its lowest position as shown in FIG. 8. From this point rack 12 can be lifted vertically and rod 37 can be placed in any position on rack 12. This process can continue until rod 37 is once again places in the reset position allowing rack 12 to be lowered into its lowest position.

Figure 12:
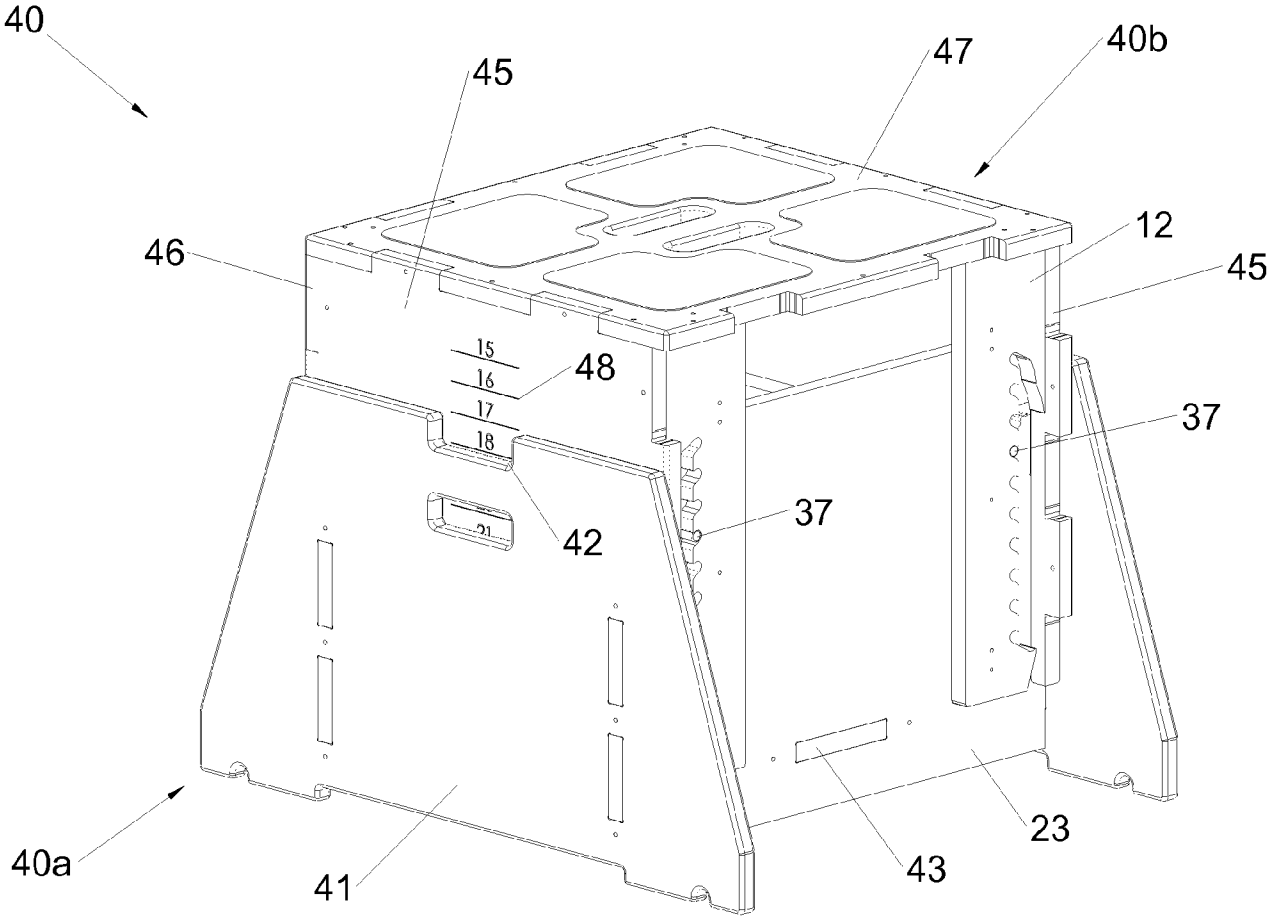
FIG. 12 illustrates an embodiment of a plyometrics exercise assembly combined with an embodiment of the recirculating ratchet assembly.

As shown in FIG. 12, the ratcheting assembly 10 is combined with a plyometrics exercise assembly 40 to provide box assembly 40 with a recirculating, ratcheting movement. Exercise assembly 40 comprises at least two sub-assemblies, base assembly 40*a* and box assembly 40*b*. Base assembly 40*a* comprises at least two base side walls 41 alternately interconnected with at least two side plates 23, at least one base plate 43, and at least one rod 37. Box assembly 40*b* comprises at least two box indicia walls 45 alternately interconnected with at least two box side walls 46 (only one visible in FIG. 12), at least one ratchet 12, and at least one exercise platform 47.

Each indicia wall 45 comprises at least one measurement indicia 48 utilized to determine how far box assembly 40*b* has been raised. At least one of base side walls 41 may also comprise at least one indicia slot or groove 42, which clearly indicates the measurement.

Figure 13:
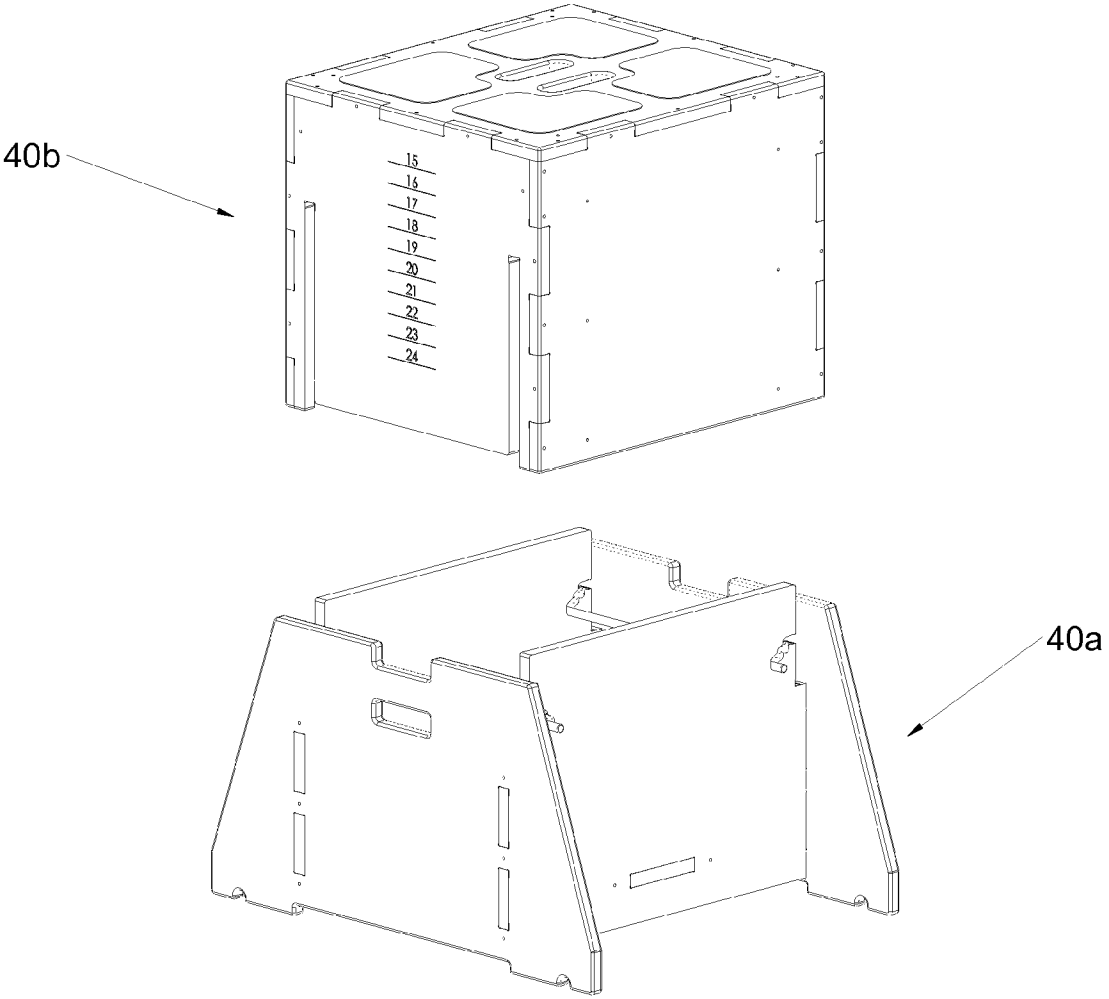
FIG. 13 illustrates an embodiment of the plyometrics exercise assembly separated into base and box sub-assemblies.

FIG. 13 shows separate fully assembled embodiments of base assembly 40*a* and box assembly 40*b*.

Figure 14:
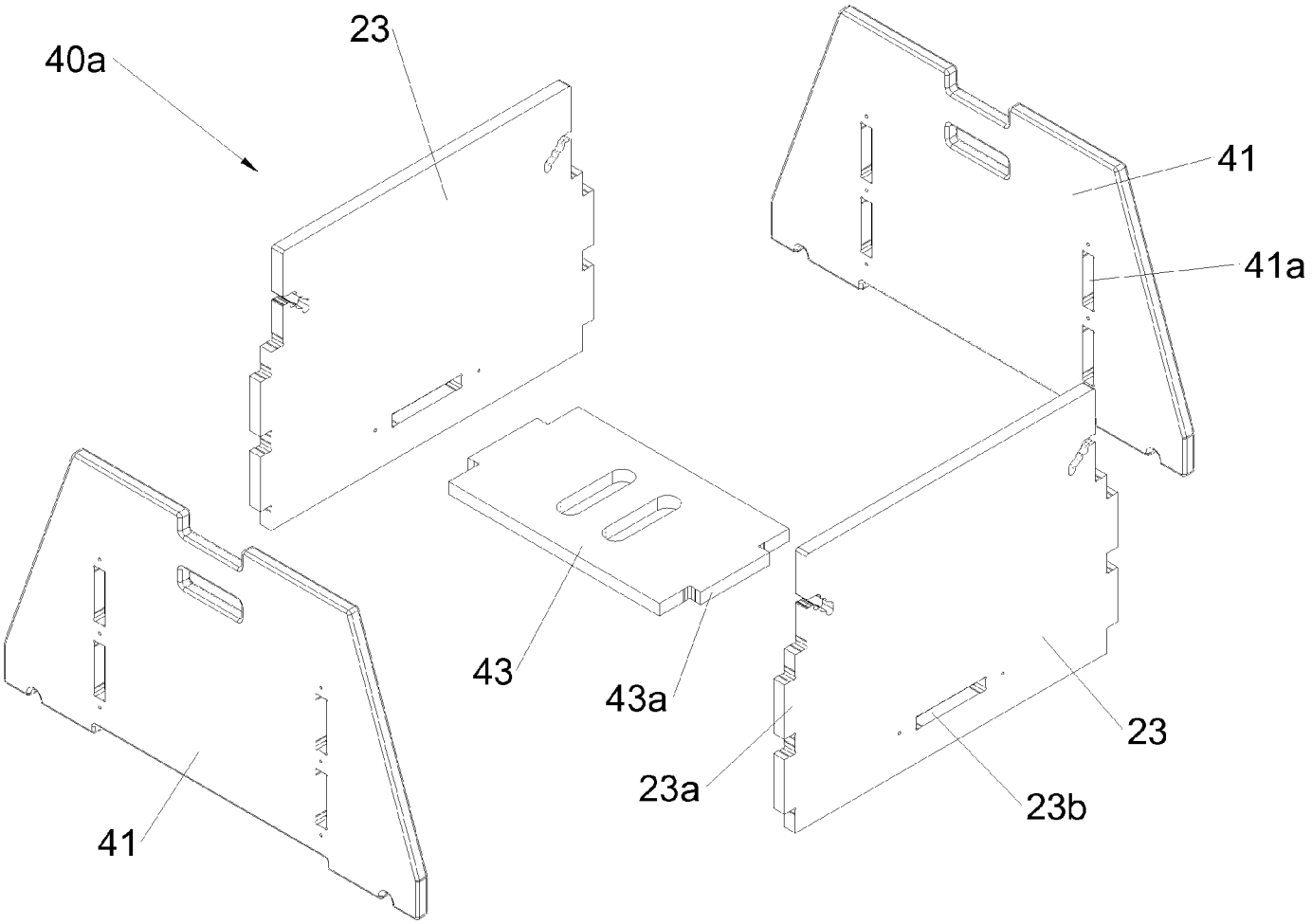
FIG. 14 illustrates an exploded isometric view of the base assembly of FIG. 13.

FIG. 14 illustrates an exploded isometric view of base assembly 40*a*. Each lateral side of side plate 23 comprises at least one tab 23*a*. During assembly, tab 23*a* is inserted into at least one slot 41*a* of a base side wall 41. Side plate 23 also comprises at least one slot 23*b*. During assembly, slot 23*b* receives at least one tab 43*a* of base plate 43. The components of base assembly 40*a* are thereby strongly interconnected.

Figure 15:
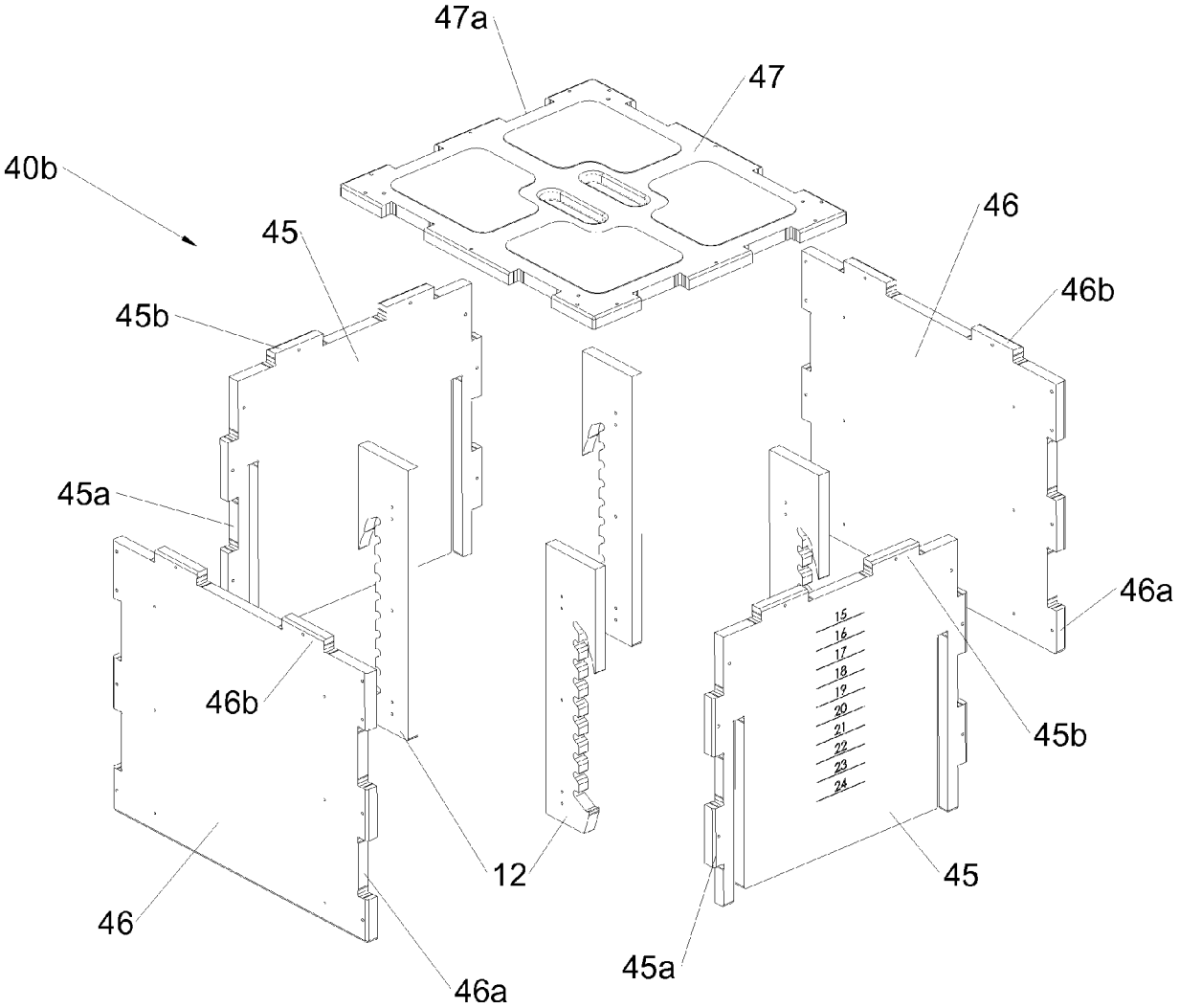
FIG. 15 illustrates an exploded isometric view of the box assembly of FIG. 13.

FIG. 15 illustrates an exploded isometric view of box assembly 40*b*. Each lateral side of each indicia 45 and side 46 wall comprises at least one tab-and-groove configuration 45*a* and 46*a*, respectively. During assembly, tabs of configuration 45*a* are inserted into complementary grooves of configuration 46*a*. Likewise, tabs of configuration 46*a* are inserted into complementary grooves of configuration 45*a*. Each side of exercise platform 47 also comprises at least one slot 47*a*. During assembly, slot 47*a* receives at least one tab 46*b* of side wall 46 or at least one tab 45*a* of indicia wall 45. The components of box assembly 40*b* are thereby strongly interconnected.

In various embodiments the components of box assembly 40*b* may be connected by screws, bolts, nails, or adhesives, interlocking components or by any other mechanical means known in the art.

Figure 16A:
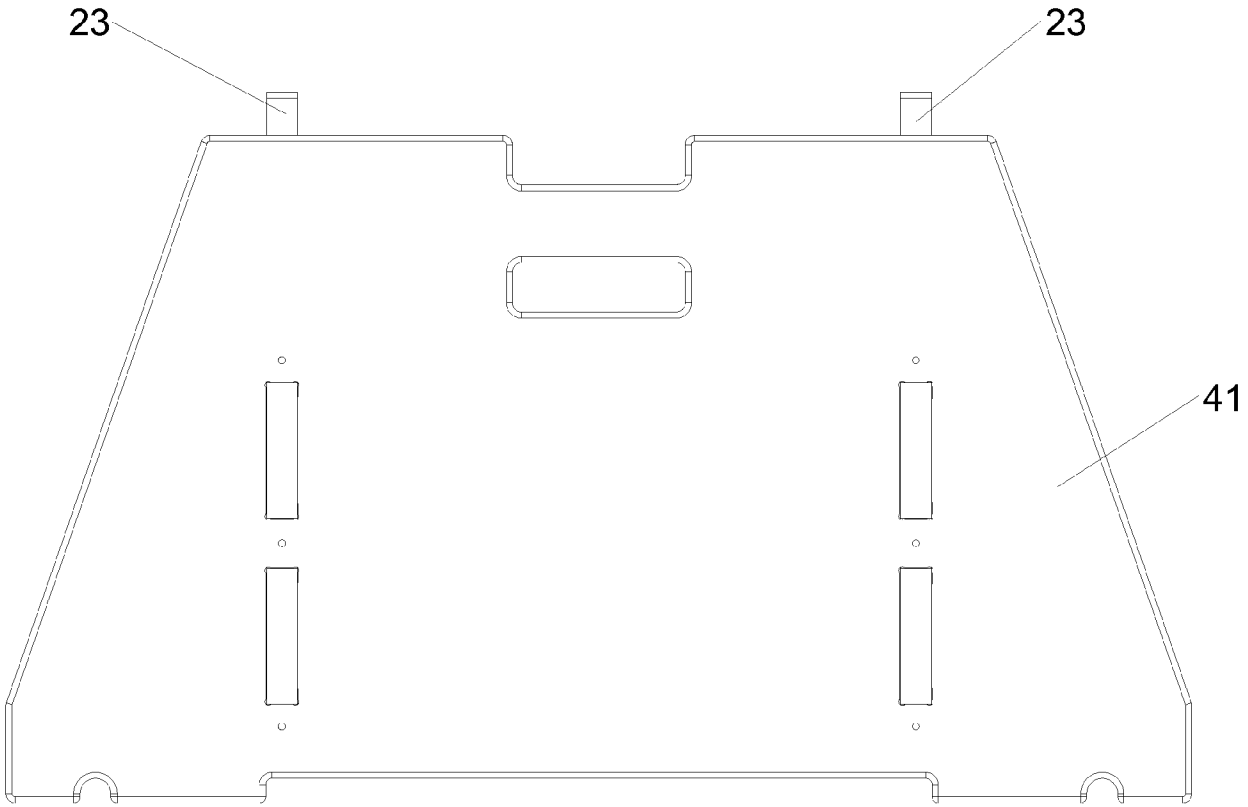
FIG. 16A shows a first side view of the base assembly of FIG. 13.
Figure 16B:
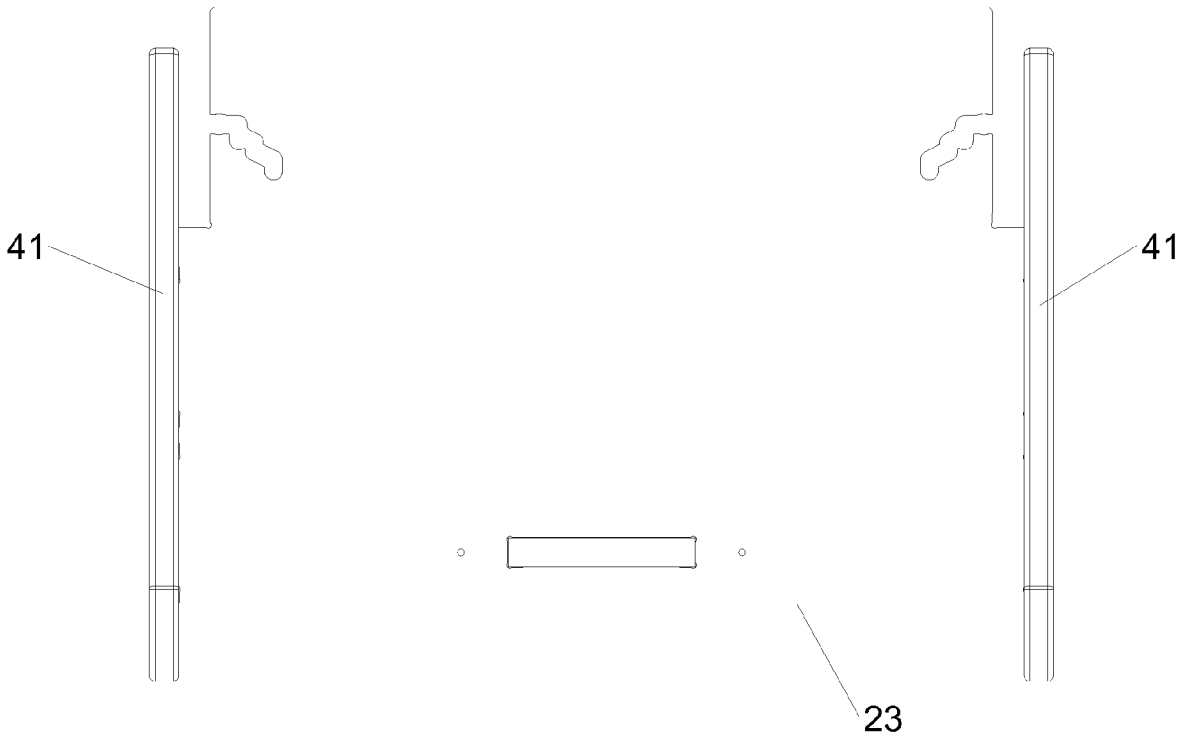
FIG. 16B shows a second side view the base assembly of FIG. 13, rotated through 90 degrees from FIG. 16A.
Figure 16C:
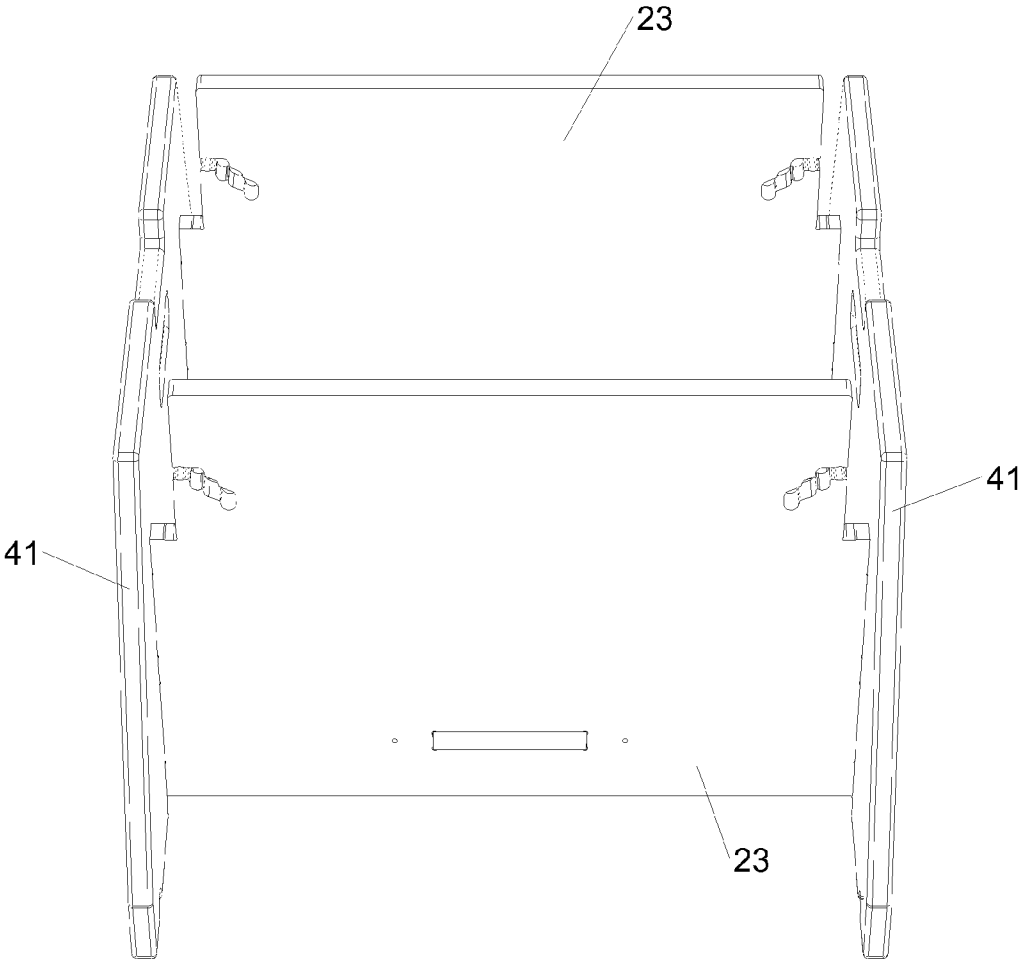
FIG. 16C shows an isometric overview of the base assembly of FIG. 13.

FIGS. 16A, 16B, and 16C show a first side view of base assembly 40*a*, second side view of base assembly 40*a* rotated through 90 degrees from the previous view, and isometric overview of base assembly 40*a*, respectively.

Figure 17A:
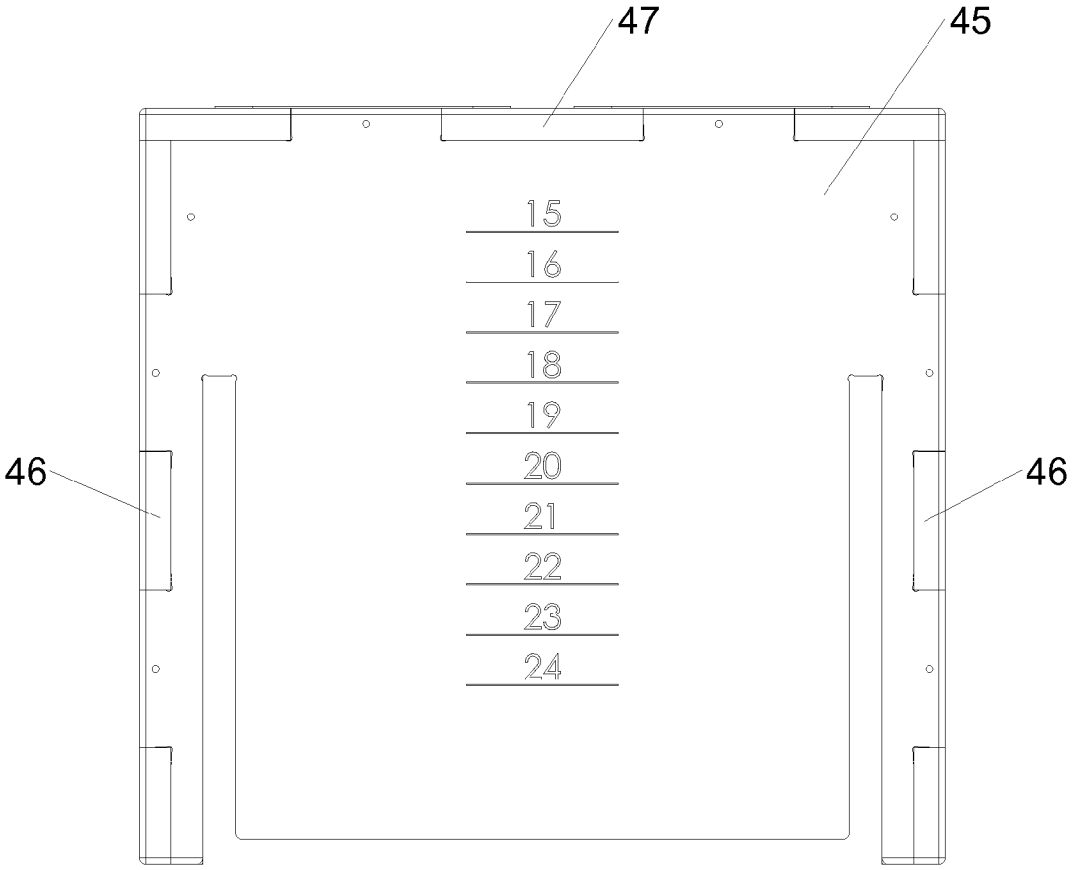
FIG. 17A shows a first side view of the box assembly of FIG. 13.
Figure 17B:
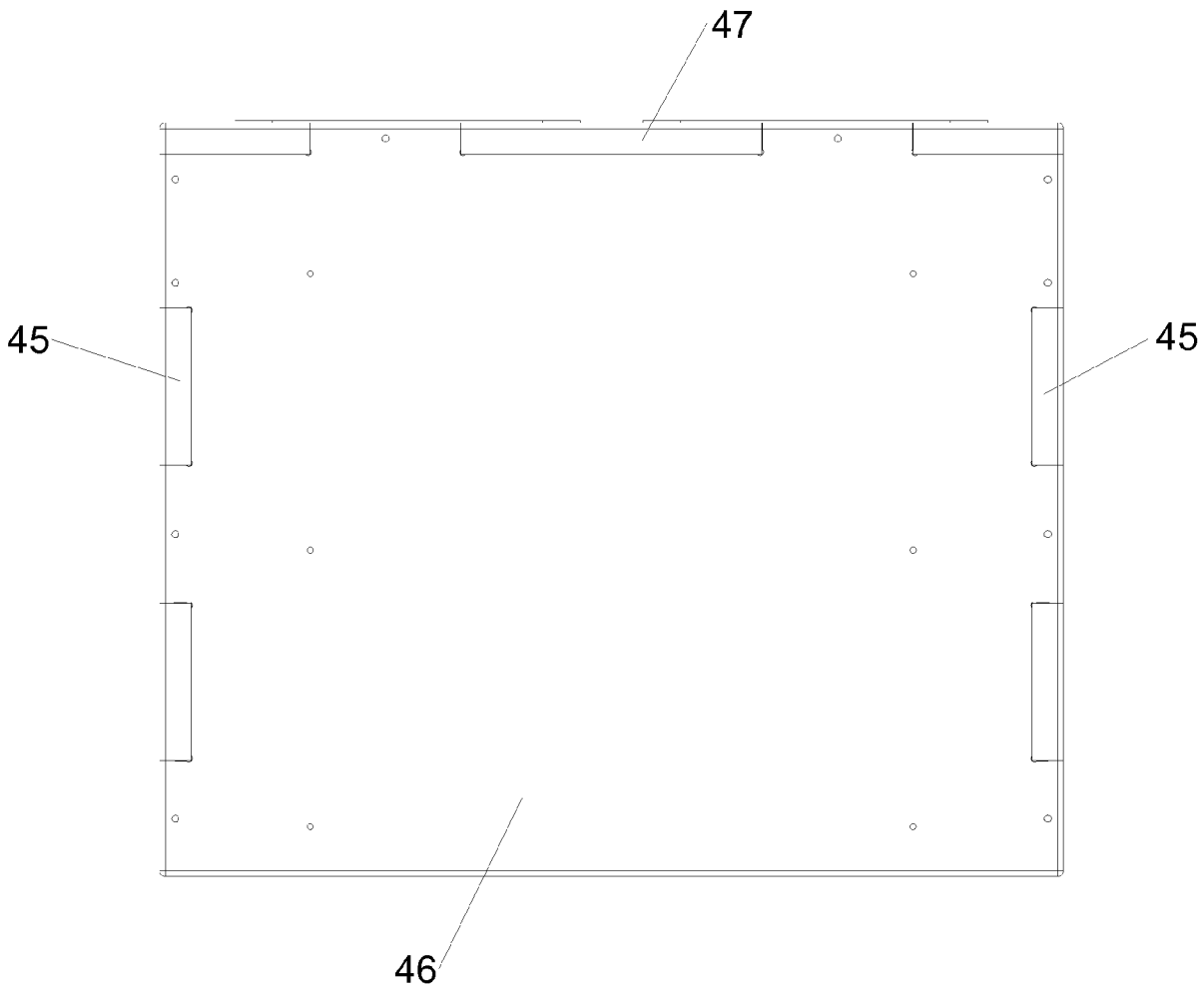
FIG. 17B shows a second side view the box assembly of FIG. 13, rotated through 90 degrees from FIG. 16A.
Figure 17C:
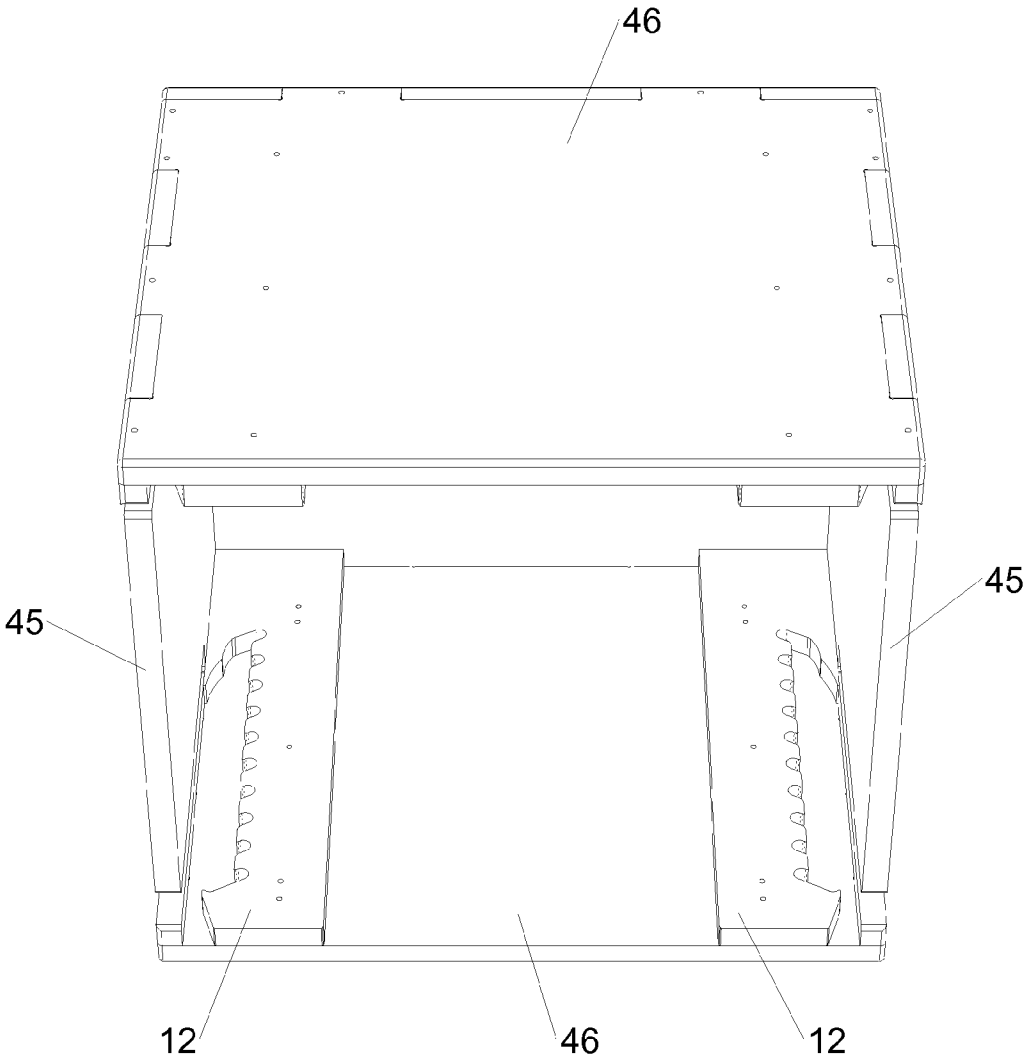
FIG. 17C shows an isometric underview of the box assembly of FIG. 13.

FIGS. 17A, 17B, and 17C show a first side view of box assembly 40*b*, second side view of box assembly 40*b* rotated through 90 degrees from the previous view, and isometric underview of box assembly 40*b*, respectively. Plyometrics exercise assembly 40 is preferably constructed of engineered wood, such as high-density plywood.

It can be seen through the description of this invention that various alternative embodiments are possible without deviating from the scope and spirit of this invention.

What is claimed is:

1. A plyometric device comprised of:

at least one outer four-sided structure and at least one inner four-sided structure wherein said at least one outer four-sided structure and said at least one inner four-sided structure are telescoping;

at least one rod having a cylindrical face;

wherein at least a first side and a second side of said inner structure have at least one slot having a diameter equal to or larger than said cylindrical face of said at least one rod;

wherein at least two sides of said outer four-sided structure have a series of contours comprising a plurality of semi-circular contours and a straight segmented contour, wherein said plurality of semi-circular contours are adjoined by said straight segmented contour and wherein said straight segmented contour is downward sloping;

wherein said series of contours begin at an angled upper surface and end at an angled lower surface;

wherein said plurality of semi-circular contours each have a radius equal to or larger than said cylindrical face of said at least one rod;

wherein said straight segmented contour has a uniform angle between twenty and seventy degrees to guide said at least one rod in an upward and laterally outward direction;

wherein each of said at least one slot comprises at least a first region, a second region, and a third region, wherein said regions are contiguous and wherein said first region underlies said plurality of semi-circular contours; and wherein said downward sloping contours exert a physical pressure on said at least one rod into said second region when said at least one outer four-sided structure is raised.

2. The device of claim 1, wherein the position of said at least one rod within said first region and said plurality of semi-circular contours operate as a stop to prevent downward movement of said at least one outer four-sided structure relative to said at least one inner four-sided structure.

3. The device of claim 1, wherein said second region is smoothly continuous with said first region such that said at least one rod freely slides from said second region to said first region when said at least one outer four-sided structure is lowered.

4. The device of claim 1, wherein said plurality of semi-circular contours comprises at least nine semi-circular contours.

5. The device of claim 1, wherein said plurality of semi-circular contours are spaced one inch apart.

6. A plyometric device comprised of:

at least one outer four-sided structure and at least one inner four-sided structure wherein said at least one outer four-sided structure and said at least one inner four-sided structure are telescoping;

at least one rod having a cylindrical face;

wherein at least a first side and a second side of said inner structure have at least one slot having a diameter equal to or larger than said cylindrical face of said at least one rod;

wherein at least two sides of said outer four-sided structure have a series of contours comprising a plurality of semi-circular contours and a straight segmented contour, wherein said plurality of semi-circular contours are adjoined by said straight segmented contour and wherein said straight segmented contour is downward sloping;

wherein said series of contours begin at an angled upper surface and end at an angled lower surface;

wherein said plurality of semi-circular contours each have a radius equal to or larger than said cylindrical face of said at least one rod;

wherein said straight segmented contour has a uniform angle between twenty and seventy degrees to guide said at least one rod in an upward and laterally outward direction;

wherein each of said at least one slot comprises at least a first region, a second region, and a third region, wherein said regions are contiguous and wherein said first region underlies said plurality of semi-circular contours; and wherein said downward sloping contours push said rod into said third region when said at least one outer four-sided structure is raised beyond a maximum point.

7. The device of claim 6, wherein said at least one rod is perpendicular to said first side and said second side of said inner structure.

8. The apparatus of claim 6 wherein said wherein each of said downward sloping contours have a uniform angle between thirty and sixty degrees to guide said at least one rod in a upward and laterally outward direction.

9. The apparatus of claim 6 wherein said at least one outer four-sided structure and said at least one inner four-sided structure are comprised of a hollow polymer.

10. The apparatus of claim 6 wherein said at least one outer four-sided structure and said at least one inner four-sided structure are comprised of engineered lumber having alternating grain layers.

11. A plyometric device comprised of:

at least one outer four-sided structure and at least one inner four-sided structure wherein said at least one outer four-sided structure and said at least one inner four-sided structure are telescoping;

at least one rod having a cylindrical face;

wherein at least a first side and a second side of said inner structure have at least one slot having a diameter equal to or larger than said cylindrical face of said at least one rod;

wherein at least two sides of said outer four-sided structure have a series of contours comprising a plurality of semi-circular contours and a straight segmented contour, wherein said plurality of semi-circular contours are adjoined by said straight segmented contour and wherein said straight segmented contour is downward sloping;

wherein said series of contours begin at an angled upper surface and end at an angled lower surface;

wherein said plurality of semi-circular contours each have a radius equal to or larger than said cylindrical face of said at least one rod;

wherein said straight segmented contour has a uniform angle between twenty and seventy degrees to guide said at least one rod in an upward and laterally outward direction;

wherein each of said at least one slot comprises at least a first region, a second region, and a third region, wherein said regions are contiguous and wherein said first region underlies said plurality of semi-circular contours; and further including a raised ridge between said second and third regions to prevent said at least one rod from leaving said third region.

12. The device of claim 11, wherein said series of contours push said at least one rod from said third region into said second region of at least one downward sloping contour when said at least one outer four-sided structure is lowered.

13. The device of claim 12, wherein said angled upper surface of said series of contours further includes an arc-shaped surface to push said at least one rod into one of said plurality of semi-circular contours when said at least one outer four-sided structure is lowered.

14. The device of claim 11, wherein said at least one rod passes from said first side of said inner structure to said second side of said inner structure.

15. The device of claim 14, wherein said at least one rod comprises at least two rods, said rods parallel to each other.

16. The apparatus of claim 11 wherein said at least one outer four-sided structure and said at least one inner four-sided structure are comprised of polymer.

* * * * *